US005289853A

United States Patent [19]

Schaefer

[11] Patent Number: 5,289,853

[45] Date of Patent: Mar. 1, 1994

[54] APPARATUS FOR PRODUCING ALL METAL SPRING CUSHIONS

[75] Inventor: Lothar Schaefer, Birenbach, Fed. Rep. of Germany

[73] Assignee: Stop-choc Schwingungstechnik GmbH & Co KG, Renningen, Fed. Rep. of Germany

[21] Appl. No.: 927,286

[22] PCT Filed: Mar. 14, 1992

[86] PCT No.: PCT/EP92/00564

§ 371 Date: Sep. 23, 1992

§ 102(e) Date: Sep. 23, 1992

[87] PCT Pub. No.: WO92/16321

PCT Pub. Date: Oct. 1, 1992

[30] Foreign Application Priority Data

Mar. 25, 1991 [DE] Fed. Rep. of Germany ..... 4109738

[51] Int. Cl.[5] ..... B21F 33/00

[52] U.S. Cl. ..... 140/71 C; 29/4.55

[58] Field of Search ..... 140/71 R, 71 C, 89, 140/107; 29/4.51, 4.55, 4.56

[56] References Cited

U.S. PATENT DOCUMENTS 2,334,263 11/1943 Hartwell ..... 140/71 C 4,343,335 8/1982 Kobayashi et al. ..... 140/71 C

FOREIGN PATENT DOCUMENTS 1078525 3/1960 Fed. Rep. of Germany .

1166735 4/1964 Fed. Rep. of Germany .

*Primary Examiner*—Lowell A. Larson

*Attorney, Agent, or Firm*—Fred Philpitt

[57] ABSTRACT

For producing an all-metal spring cushion, a knitted piece knitted from spring wire is wound in a winding sleeve (14). In the winding sleeve (14), the end of the knitted piece is fixed to the knitted roll (76) by micro-welding. In a pressing station (22), the winding sleeve (14) is flush and aligned in front of a pressing sleeve (148) of the same inner diameter. The knitted roll is pushed into the pressing sleeve (148) by a press die (162) and compressed therein to form a spring cushion. Then, the spring cushion is ejected from the pressing sleeve.

15 Claims, 7 Drawing Sheets

APPARATUS FOR PRODUCING ALL METAL SPRING CUSHIONS

The invention relates to an apparatus for producing all-metal spring cushions from pieces of knitted metal.

All-metal spring cushions were produced hitherto in the following manner: the metal wire is knitted on a circular knitting machine to form a tube, which is then laid flat to form a double-layer band. The latter is provided with a transverse corrugation (goffering). Pieces of pre-determined length are cut from the goffered band and wound up to form a roll. The end of the knitted piece is fixed to the roll by hand by hooking and the knitted roll obtained in this way is pushed by hand into a mould and compressed in a press, the individual wires of the knitted layers coming into close frictional contact with each other and the spring cushion acquiring the respectively desired final geometry.

This type of production is very time-intensive.

The present invention intends to provide an apparatus for the production of all-metal spring cushions, which makes possible a largely automated production without human intervention, in particular renders superfluous the manual insertion of the knitted roll in the mould.

In the production apparatus according to the invention, the winding up of the knitted pieces takes place inside a winding sleeve, which simultaneously serves as an insertion aid for a pressing sleeve. Thus the finished knitted roll can be transferred simply mechanically from the winding station into the pressing station.

In an apparatus according to claim 2, one has a permanently fixed, clearance-free coordination between the inner surface of the winding sleeve and the inner surface of the pressing sleeve. Also one does not require any special and precisely positioning conveying means for moving the winding sleeve between the winding station and pressing station.

An apparatus according to another embodiment has the merits of a particularly simple mechanical construction. In addition, there is no junction between the winding mandrel and pressing mandrel. The press die can be moved simply across the winding mandrel.

The development of the invention according to another embodiment is an advantage with regard to simple driving of the winding mandrel.

In an apparatus according to another embodiment, one can dispense with a counter-electrode inter-wound between the uppermost layers of the knitted roll, since the welding current is guided positively in the radial direction. A counter-electrode of this type makes the mechanical construction of the apparatus more complicated, since it must be removed by a separate drive in the axial direction from the knitted coil, before the latter is compacted.

Too, the development of the invention according to another embodiment serves for fixing the end of the knitted piece to the roll by microwelds, without a counter-electrode inserted in the roll.

With the development of the invention according to another embodiment, on the one hand a particularly simple and easy stripping of the finished knitted roll from the winding mandrel is achieved. In addition, this development makes it easier to push the press die with slight radial clearance over the winding mandrel.

According to another embodiment, gripping means able to be moved out of the winding mandrel can be realised and actuated in a particularly simple manner.

The development of the invention according to another embodiment is an advantage with regard to high throughput of the production apparatus, since the winding and closing of the knitted roll and the pressing can be carried out simultaneously in different, spatially separated working stations.

In an apparatus according to another embodiment, a supply rail, by means of which the knitted piece is supplied to the winding station, can be located in a stationary manner. At the time of movement of the stepping table, it does not need to be moved out of the stepping table path.

In an apparatus according to another embodiment, the same advantage is achieved also for the fixing device, which belongs to the winding station.

In an apparatus according to another embodiment, one achieves satisfactorily reproducible microwelds for fixing the end of the knitted piece to the roll, even if the metal knitted material is not a good conductor and is not wound very tightly. In this case, the winding station in general has a construction which is neat from the mechanical point of view, since the counter-electrode and the winding mandrel are withdrawn in opposite directions from the winding sleeve, which is open at both sides.

In an apparatus according to another embodiment, it is easy to determine under how many layers of the knitted material the counter-electrode is laid in the roll.

In this case, according to another embodiment, the end of the knitted piece can be positioned very precisely in the immediate vicinity of the fixing device, taking into consideration fluctuations of length of the knitted piece.

In an apparatus according to another embodiment, with this fine positioning of the end of the knitted piece, the radius of the knitted roll is automatically taken into consideration in the determination of the residual angle of rotation for the drive operating on the winding mandrel.

The invention will be described in detail hereafter by means of embodiments, referring to the drawings, in which.

Figure 1:
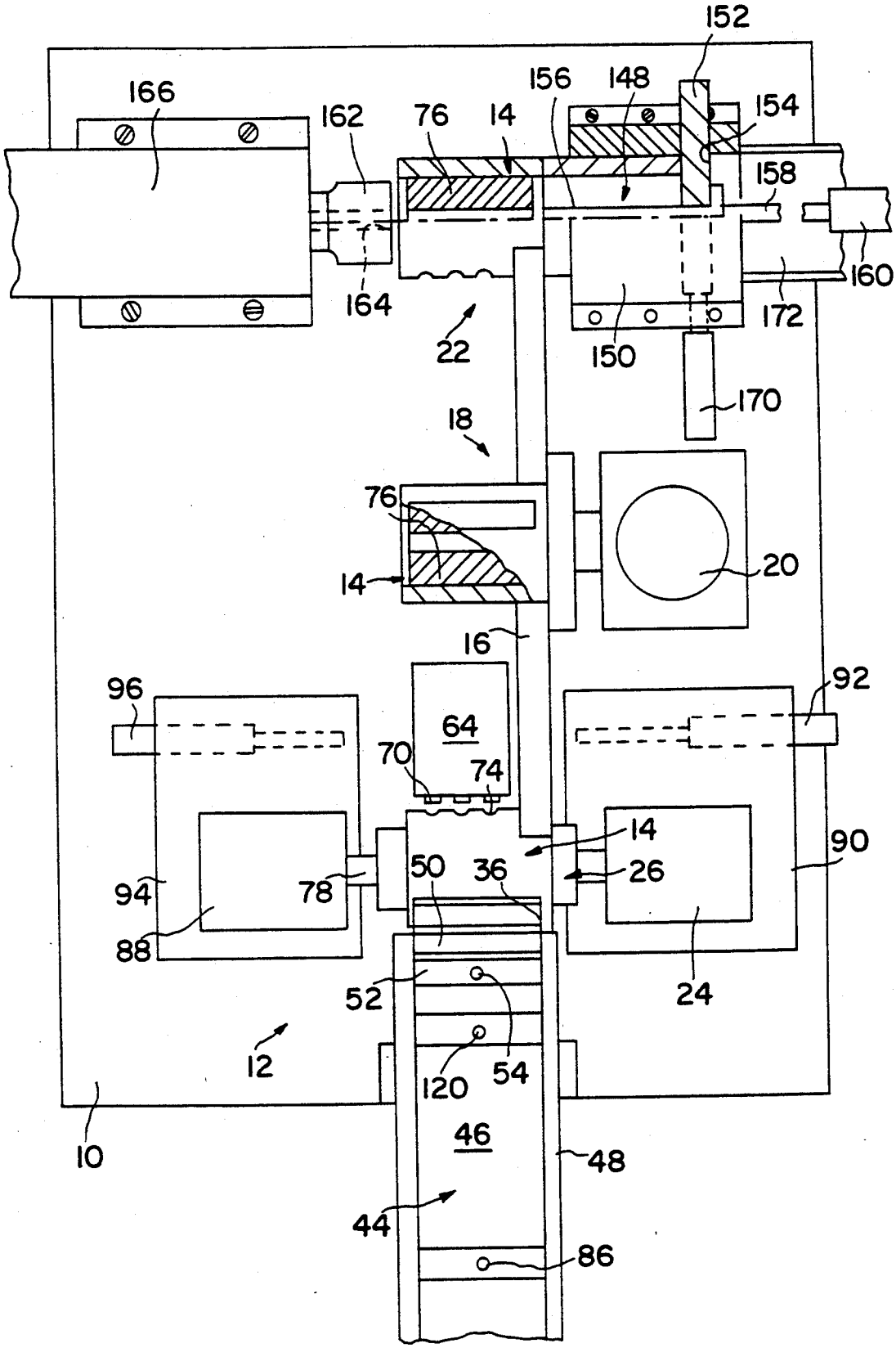
FIG. 1 is a diagrammatic plan view of a machine for producing all-metal spring cushions.

In FIG. 1, the reference numeral 10 designates a machine bed, which supports a winding station designated generally by the reference numeral 12, in which, in practice goffered knitted pieces of spring wire having a length of 1 to 2 meters are wound to form a knitted roll with a diameter of for example 4 centimeters and a height of for example 5 centimeters and the end of the knitted piece is attached to the roll by microwelds. Winding sleeves 14, in which this winding and closing of the knitted roll takes place in a manner described in detail hereafter, are fastened to arms 16 of a stepping table 18 designated generally by the reference numeral 18, which can be moved by a drive 20 in steps of 90° about a horizontal axis.

The machine bed 10 furthermore supports a pressing station designated generally by the reference numeral 22, which is located opposite the winding station 12 with respect to the axis of the stepping table 18 and in which the knitted roll is compressed axially to form a spring cushion, whereof the height amounts to approximately half the initial height of the roll.

Figure 3:
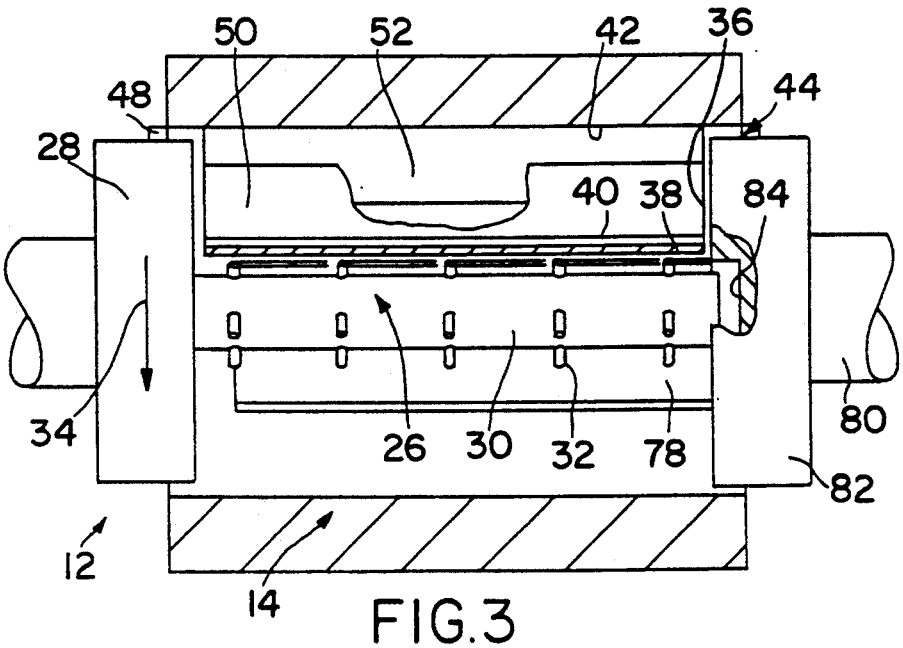
FIG. 3 is an axial section through the winding station according to FIG. 2 along the section line III—III therein.
Figure 4:
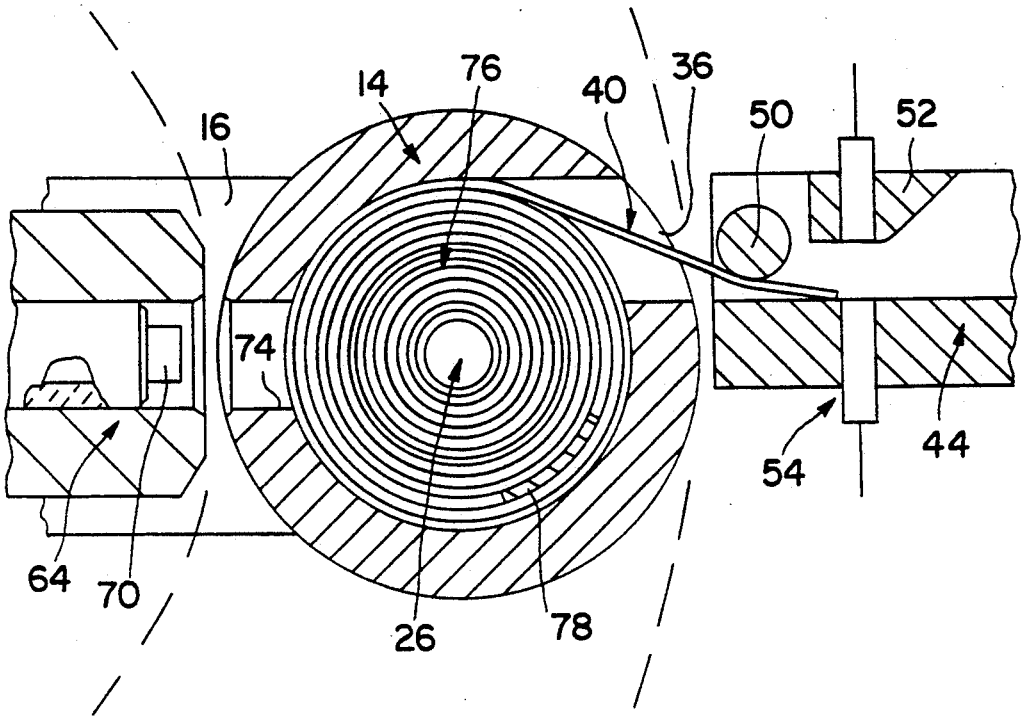
FIGS. 4 and 5 are sectional views similar to FIG. 2, in which the last two stages of the winding process are illustrated.
Figure 5:
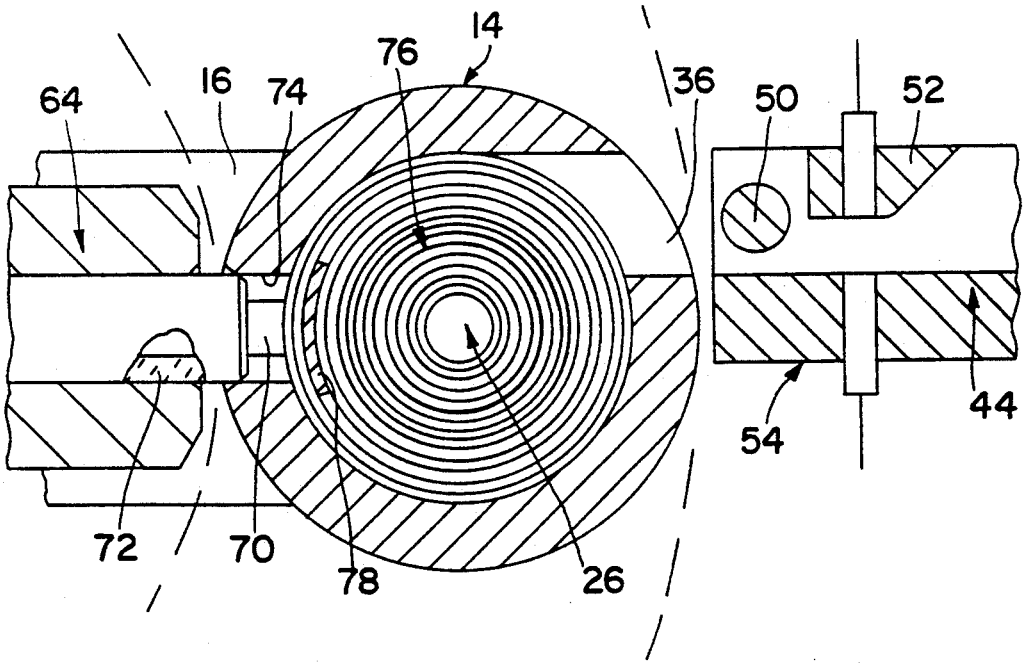

Now, details of the winding station 12 will be described with reference to FIGS. 1 to 5:

A winding drive 24 drives a winding mandrel designated generally by the reference numeral 26. The latter has a flange 28, which is able to engage in the winding sleeve 14 respectively present in the winding station under clearance by a short distance from one end of the sleeve, as shown in FIG. 3. A front winding section 30 of the winding mandrel 26 extends substantially through the entire winding sleeve 14 and on its surface supports four sets of entrainment wires 32, which are inclined in the winding direction (arrow 34).

A supply window 36 is provided in the peripheral wall of the winding sleeves 14, which are open on both sides, and are butt-joined to the associated arms 16. The lower surface 38 of the supply window 36 lies somewhat higher than the uppermost generatrix of the winding section 30, so that in the case of free-supporting feed beyond the surface 38, above the winding section 30, the free end of a knitted piece 40 comes into the path of the entrainment wires 32 rotating in the direction of the arrow 34 and is thus entrained by the winding mandrel 26. The upper surface 42 of the supply window 36 extends tangentially with respect to the inner surface of the winding sleeve 14.

A supply rail 44 is provided for the definite supply of the knitted piece 40, which rail comprises a bottom wall 46 and lateral guide walls 48. Provided at the end of the rail is a transverse, round guide rod 50, which together with a transverse strip 52 located in front of it forms an insertion funnel for the knitted piece 40 and holds the knitted piece on the bottom wall 46, so that it adopts a definite position with respect to a light barrier 54, which comprises a transmitter part 56 let into the bottom wall 46 and a receiver part 58 arranged in alignment in the strip 52.

Figure 2:
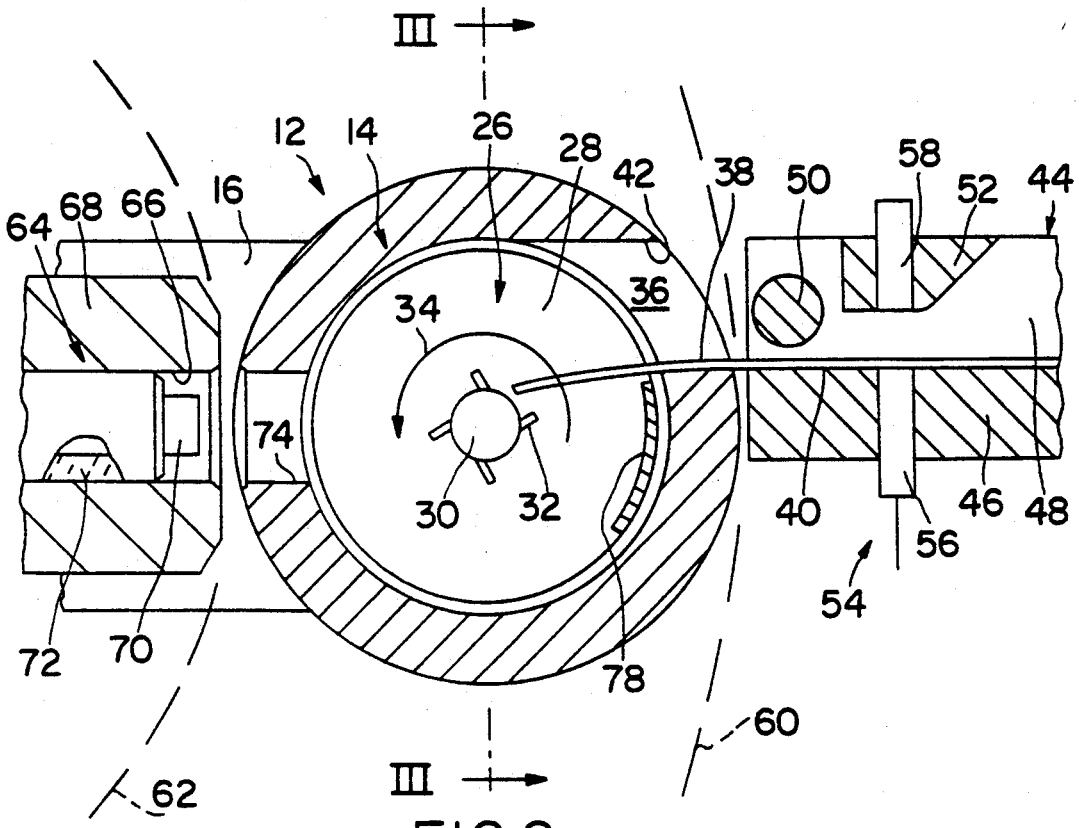
FIG. 2 is a cross-section through a winding station of the machine illustrated in FIG. 1.

In FIG. 2, the path of the outermost generatrix of the winding sleeve 14 is indicated by a broken circle 60, the path of the innermost generatrix is indicated by a broken circle 62. As can be seen from FIG. 2, the end face of the supply rail 44 is located tangentially with respect to the circle 60. Located substantially opposite the latter, tangentially with respect to the circle 62 is a welding device designated generally by the reference numeral 64. The latter comprises three welding electrodes 70 able to move in bores 66 of a housing 68, which electrodes are each guided by way of an insulating sleeve 72 in the associated bore 66. When the winding sleeve 14 is in the winding station 12, bores 74 of the winding sleeve align with the bores 66, so that the ends of the welding electrodes 70 can be moved towards the surface of the knitted web roll 76 produced in the winding sleeve 14, the end of the welding electrodes 70 being guided in the bores 74 in a manner similar to the bores 66.

The welding electrodes 70 are biased by springs (not shown), so that at the time of welding, after the softening of the knitted material, they are readjusted under elastic bias.

The welding electrodes 70 cooperate with a cylindrically curved counter-electrode 78, which is supported by an electrode shaft 80, as can be seen in particular from FIG. 3. The electrode shaft 80 is provided with a flange 82, which closes off the right-hand end of the winding sleeve 14 in the same way as the flange 28 does for the left-hand end of the sleeve. In the center, the flange 82 is provided with a recess 84, in which the end of the winding section 30 may engage with clearance.

The counter-electrode 78 is parked below the supply window 36 during the largest part of the winding operation, as is shown in FIGS. 2 and 3.

By means of a second light barrier 86 located in front of the light barrier 54, an electrode drive 88 is controlled, which works on the electrode shaft 80. The position of the second light barrier 86 is chosen so that after the counter-electrode 78 is set in rotation (likewise in the direction of the arrow 34) a maximum number of knitted layers is wound over the counter-electrode 78 and the end of the knitted piece 40 lies behind the center of the counter-electrode 78 by the size of the weld spots. Thus, the outermost end of the knitted piece 40 is effectively fixed to the knitted roll 40 and one has no projecting ends, which would impair later handling of the knitted roll, but also of the finished spring cushion. Details of the control of the electrode drive 88 will be given hereafter with reference to FIG. 6.

As can be seen in FIG. 1, the winding drive 24 is seated on a first carriage 90 able to move parallel to the axis of the stepping table 18, which carriage is moved by a double-acting hydraulic working cylinder 92. In a similar manner, the electrode drive 88 is seated on a carriage 94, which is moved by a double-acting working cylinder 96. Due to a corresponding supply to the working cylinders 92, 96, the winding mandrel 26 and the counter-electrode 78 are thus withdrawn in the axial direction from the knitted roll produced in the winding sleeve 14 present in the winding station 12, and then this winding sleeve 14 can be moved by the stepping table 18 first into a 90° intermediate position and then into a 180° pressing position.

In order to reduce the friction between the stationary winding sleeve 14 and the outer surface of the rotating knitted roll 76, the inner surface of the winding sleeve may be provided with closely adjacent, semi-circular sliding ribs 98, as illustrated in FIG. 1.

Each time the stepping table 18 is indexed to the next position, an empty winding sleeve 14 arrives in the winding station 12 and by a corresponding supply of pressure medium to the working cylinders 92, 96, a winding mandrel 26 and counter-electrode 78 are respectively introduced axially into the inside of the respective winding sleeve 14, so that at the beginning of a winding process, one has the initial conditions illustrated in FIGS. 2 and 3.

Figure 6:
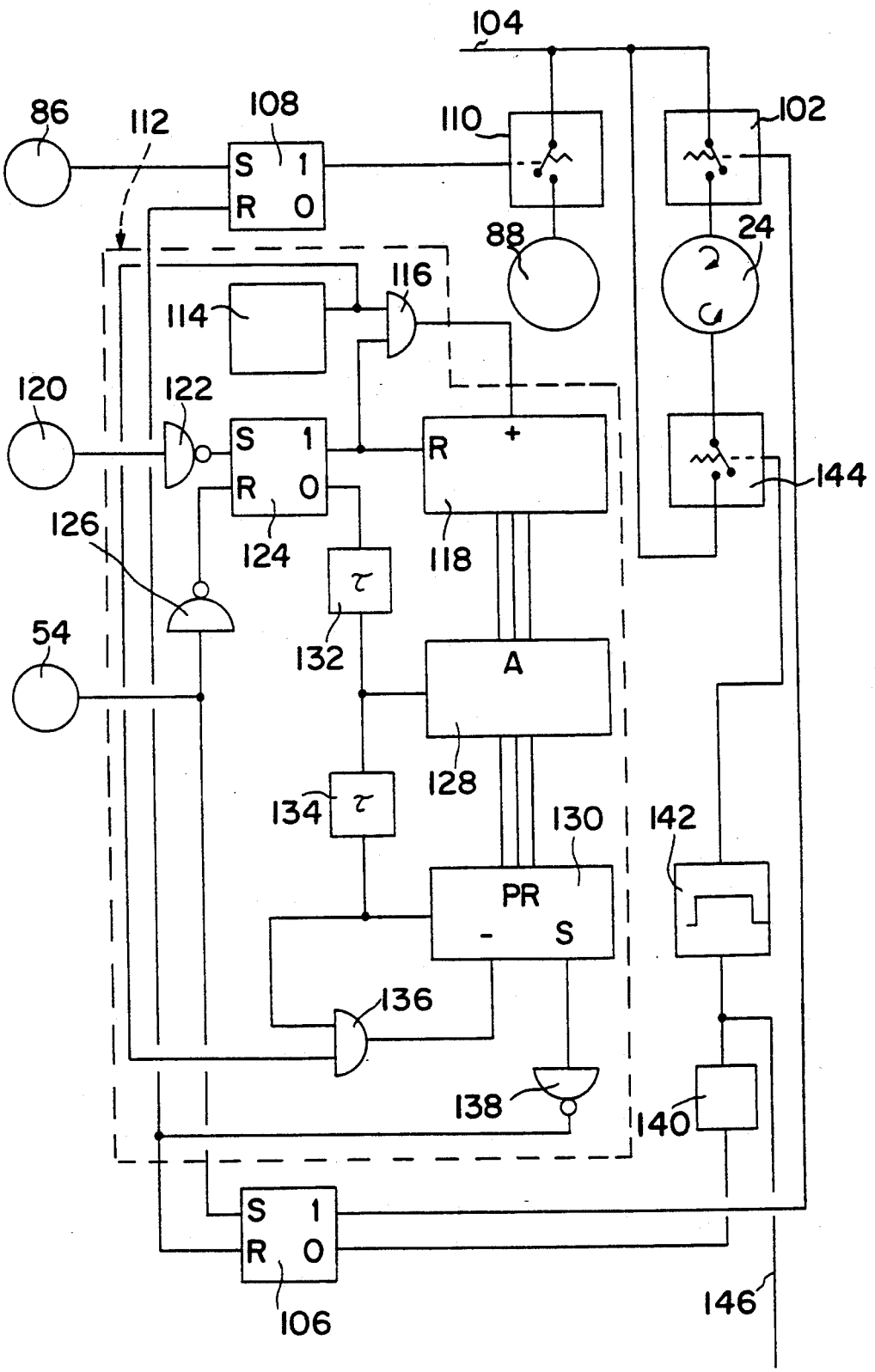
FIG. 6 is a block circuit diagram of a control device for the winding station of the machine according to FIG. 1.

As can be seen from FIG. 6, the winding drive 24 may be connected by way of a controllable switch 102 to a mains lead 104, in order to set the winding mandrel 26 in rotation in the direction of the arrow 34. The control of the switch 102 takes place from the "1"-output of a bistable flip-flop circuit 106, the setting output "S" of which is connected to the output of the first light barrier 54. In FIG. 6, all the components able to be triggered by edges are supposed to be components responding to leading signal edges.

The output signal of the second light barrier 86 is sent to the setting input of a further bistable flip-flop circuit 108, whereof the "1"-output is connected to the control terminal of a further switch 110. The electrode drive 88 may be connected by way of the latter to the mains lead 104. The stopping of the winding drive 24 and electrode drive 88 takes place simultaneously by resetting the two bistable flip-flop circuits 106 and 108 depending on the trailing signal edge of the light barrier 54 by a specially constructed digital residual angle control circuit 112.

The residual angle control circuit 112 is connected to a synchro 114 cooperating with the winding drive 24 and producing one pulse respectively for a given angular increment, the output signal of which synchro is sent by way of an AND-gate 116 to an auxiliary counter 118.

Located a short distance before the light barrier 54 is a further light barrier 120, whereof the output signal is connected by way of an inverter 122 to the setting terminal of a bistable flip-flop circuit 124. Its "1"-output controls the second terminal of the AND-gate 116. At the same time as the setting of the flip-flop circuit 124, the auxiliary counter 118 is also reset to zero.

For its own resetting, the flip-flop circuit 124 receives the output signal from the light barrier 54 by way of an inverter 126. The count respectively obtained in the auxiliary counter 118 thus corresponds to that number of angular increments of the winding drive 24, which were necessary for moving the end of the knitted piece from the light barrier 120 to the light barrier 54. This number is dependent on the respective radius of the knitted roll 76. From this number it is possible to calculate with better accuracy by how many angular steps the winding drive 24 must be moved on, in order that the end of the knitted piece 40 comes to lie directly in front of the welding electrodes 70.

This calculation takes place digitally so that with the output signal of the auxiliary counter 118 one controls a correction memory 128, in which the corresponding angular values were fed in previously. The respective correct residual angular value is supplied as an increment number to the pre-setting terminals PR of a counter 130. The activation of the correction memory 128 and of the counter 130 takes place by way of delay members 132, 134 from the "0"-output of the flip-flop circuit 124.

Due to the output signal of the delay member 134 and AND-gate 136 is simultaneously connected through, by means of which the output pulses of the synchro 114 are sent to a down counting terminal of the counter 130. The output signal at the sign terminal S of the counter 130 may then be used by way of an inverter 138 for resetting the bistable flip-flop circuits 106 and 108. The end of the knitted piece now lies shortly in front of the welding electrodes 70.

Due to the "0"-output signal of the bistable flip-flop circuit 106, by way of a delay circuit 140, whereof the period is somewhat longer than the time required for welding the end of the knitted piece to the knitted roll, a monostable flip-flop circuit 142 is also actuated. The latter controls a switch 144, by which a second supply terminal of the winding drive 24 may be connected to the mains lead 104, upon the actuation of which the winding drive 24 is driven in the opposite direction to that of the arrow 34. In this direction of rotation, the entrainment wires 32 work out of the knitted roll 76. The period of the flip-flop circuit 142 corresponds to the time required for pulling the winding mandrel 26 out of the knitted roll.

The output signal of the monostable flip-flop circuit 142 is made available on a lead 146, in order to bring about a simultaneous, oppositely directed axial withdrawal of the winding mandrel 26 and counter-electrode 78 from the knitted roll 76 by supplying pressure medium in a corresponding manner to the working cylinders 92, 96.

Figure 7:
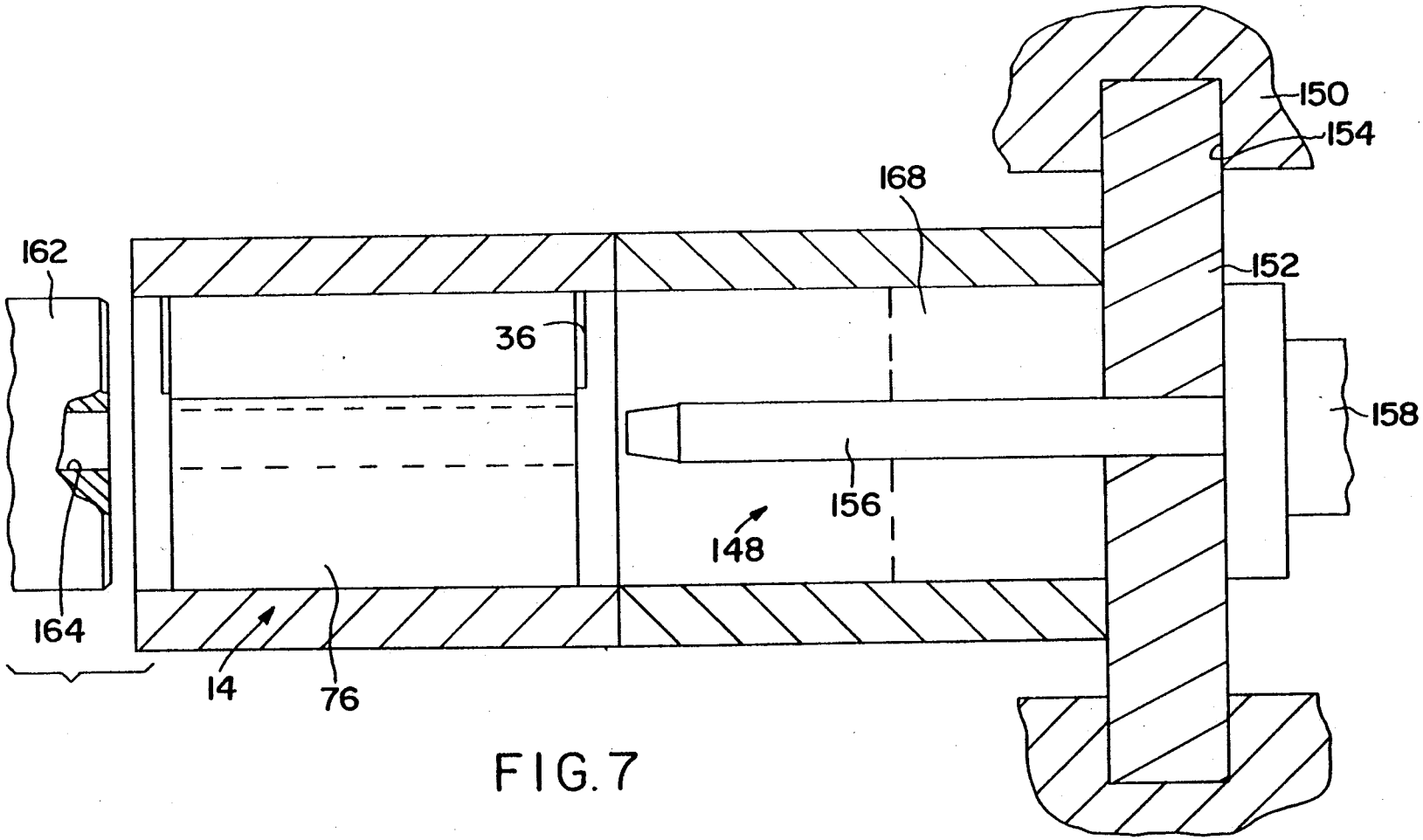
FIG. 7 is a longitudinal section through the main parts of a pressing station of the machine illustrated in FIG. 1.

As shown in FIGS. 1 and 7, in the pressing station 22, a winding sleeve 14 aligns respectively with a pressing sleeve 148 so that the inner surfaces of both sleeves present a flush transition. The pressing sleeve 148 is securely connected to the machine bed 10 by a mounting 150. Its base is formed by a slide 152, which travels in guide grooves 154 integral with the frame.

A pressing mandrel 156 is guided by the slide 152, which mandrel is connected to the piston rod 158 of a double-acting working cylinder 160.

A press die 162 can be moved through the winding sleeve 14 and into the pressing sleeve 148 and thereby pushes the knitted roll 76 into the pressing sleeve 148 and onto the pressing mandrel 156. The press die 162 has a central bore 164, into which the pressing mandrel 156 may travel. Upon further advance of the press die 162, through the associated pressing cylinder 166, the knitted roll 76 is compressed between the slide 152 and the end face of the press die 162.

After maintaining the pressing time over a predetermined time interval, the pressing cylinder 166 is then relieved and the pressing mandrel 156 is withdrawn by the working cylinder 160 from the finished spring cushion, which is shown in broken line at 168 in FIG. 7. The return of the pressing mandrel 156 takes place until it is behind the slide 152, so that the latter can then be moved away in a direction perpendicular to the plane of the drawing of FIG. 7, by a double-acting working cylinder 170 (see FIG. 1). Due to a further advance of the press die 162, the finished spring cushion is then ejected from the pressing sleeve 148 and reaches a discharge chute 172.

Then the press die 162 is moved back into the initial position shown in FIG. 7, in the same way as the slide 152 and the pressing mandrel 156. Then, a further winding sleeve 14 with a further knitted roll 76 can be moved into the pressing station 22.

In FIG. 7, the welding points, by which the ends of the knitted members are fixed to the knitted roll, are indicated diagrammatically by crosses.

Figure 8:
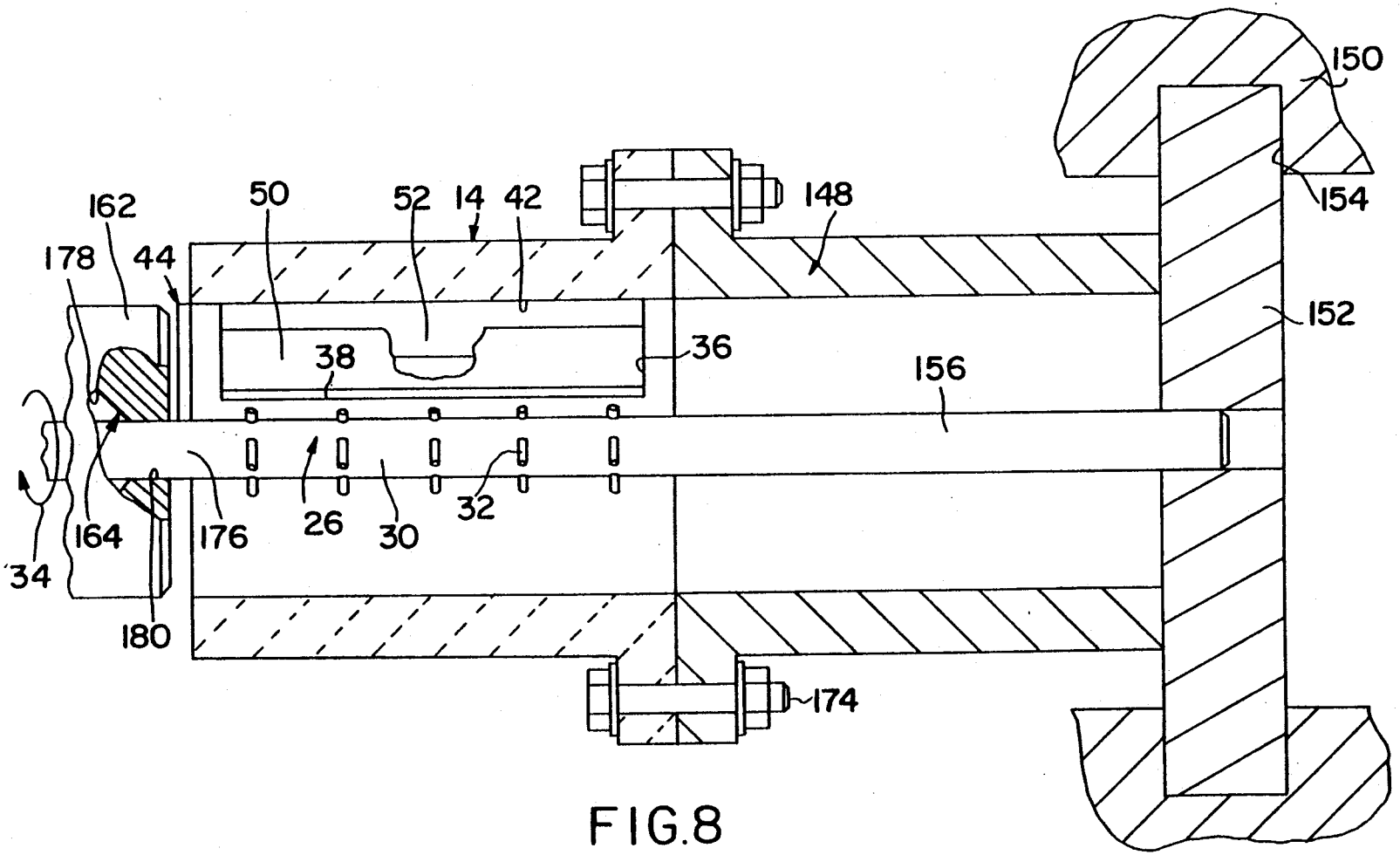
FIG. 8 is a longitudinal section through a combined winding/pressing station.

In a modified apparatus for the production of spring cushions, whereof the most important parts are illustrated in FIG. 8, the winding, welding and pressing takes place in a single working station. Parts of the apparatus, which have already been described above with reference to FIGS. 1 to 7 and with a comparable function, are once again provided with the same reference numerals and are not described again in detail.

The winding sleeve 14 is now made from electrically insulating material, for example a ceramic material and connected directly by way of bolts 174 to the pressing sleeve 148.

The winding mandrel 26 has a shaft section 176, rotatably extending through the press die 162 and the press mandrel 156 is formed integral with the winding mandrel 26.

The bore 164 has a rear bore section 178 of larger diameter, which can receive the resilient entrainment wires 32 under clearance, whereas a bore section 180 matching the pressing mandrel 156 and supporting the pressing surface has only a short axial dimension.

A rotary drive for the winding mandrel 26 is seated behind the press die 162 and is once more mounted on a carriage in a similar manner to that illustrated in FIG. 1.

As regards the winding of a knitted piece, the combined winding/pressing station according to FIG. 8 works exactly as described above. However, the welding of the end of the knitted piece takes place by the welding device 64 to be imagined above the plane of the drawing, without a separate counter-electrode. The lower layers of the knitted roll in conjunction with the winding mandrel 26 serve as the counter-electrode. Since the winding sleeve 14 is electrically non-conducting, one thus also has a defined current away from the welding electrodes in the radial direction.

When the knitted roll 76 is finished, in the apparatus according to FIG. 8, the press die 162 is simply moved towards the slide 152. When the knitted roll is adequately compacted, the winding drive in FIG. 8 is moved towards the left, due to which the pressing mandrel 156 is withdrawn from the slide 152 and the finished spring cushion. Then the slide 152 is moved away and the spring cushion is ejected by a further advance of the press die 162.

It can be seen that the axial stroke of the carriage supporting the winding drive in this case needs solely to be shorter, namely somewhat larger than the axial dimension of the finished spring cushion. Also, a stepping table occupying precise angular positions is not required.

Figure 9:
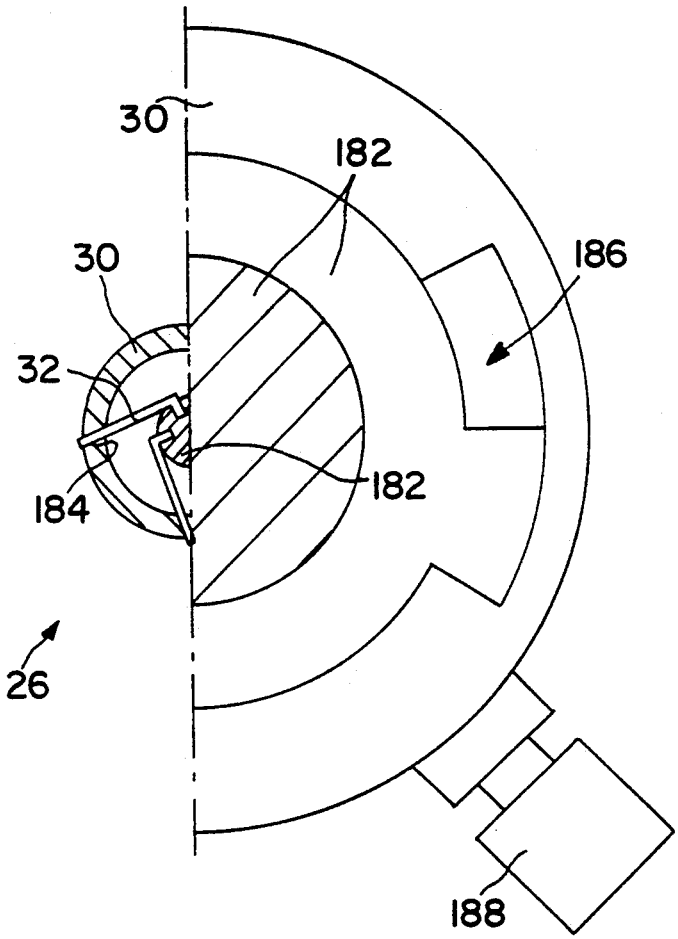
FIG. 9 is an axial plan view of the end of the winding mandrel at the driving side, of the combined station according to FIG. 8 and a transverse half section through the working section of the winding mandrel.

In order to facilitate the travel of the press die 162 over the winding mandrel 26, the entrainment wires 32 can also be made so that they can be retracted substantially into the surface of the winding mandrel 26, as shown in FIG. 9. The entrainment wires 32 are supported extending tangentially away from an adjusting shaft 182 and penetrate openings or slots 184 facilitating tilting, in the winding mandrel 26 which is now constructed to be hollow. The adjusting shaft 182 is connected to the winding drive and entrains the winding mandrel 26 by way of a lost motion connection 186 operating in the angular direction. Upon rotation of the adjusting shaft 182 in the direction of the arrow 34, the entrainment wires 32 are extended automatically, upon rotation of the adjusting shaft 182 in the opposite direction, they are retracted automatically. Normally, the friction between the knitted roll 76 and winding sleeve 14 or the inertia of the winding mandrel 26 is sufficient for reversing the lost motion connection. If not, the driven part of the lost motion connection can be braked by an additional brake 188, which may be a solenoid brake excited solely at the time of reversal.

As a modification of the embodiment according to FIG. 8, the microwelds may also be produced by microflames, which are directed through the bores 74 towards the end of the knitted roll 76. The microflames may either be flames produced by burning gas or arcs maintained between two electrodes.

I claim:

1. Apparatus for producing all-metal spring cushions from knitted pieces produced from metal wire, characterised by a) a winding station (12), which comprises:
  aa) a winding mandrel (26) provided with entrainment means (32) and connected to a winding drive (24),
  ab) at least one open winding sleeve (14), which is located coaxially with respect to the winding mandrel (26) and in the peripheral wall of which there is provided a supply window (36) for the knitted piece (40) to be wound,
  ac) a fixing device (64) for fixing the end of the knitted piece to the knitted roll (76), and
  ad) stripping means (90, 92) for stripping a finished knitted roll (76) from the winding mandrel (26);

b) a pressing station (22), which comprises:
  ba) a pressing sleeve (148) with a peripheral wall free from interruptions, whereof the inner diameter corresponds substantially to the inner diameter of the winding sleeve (14) and with which a sleeve bottom member (152) is associated,
  bb) a central pressing mandrel (156), whereof the diameter corresponds essentially to the diameter of the winding mandrel (26),
  bc) a press die (162) with a central bore (164) able to move over the pressing mandrel (156) and
  bd) ejection means (162) for ejecting a spring cushion (168) obtained by compressing a knitted roll (76), from the pressing sleeve (148); and by c) means (18; 174) for axially aligning the winding sleeve (14) and pressing sleeve (148).

2. Apparatus according to claim 1, characterised in that the winding sleeve (14) and pressing sleeve (148) are fixedly connected one to the other (174).

3. Apparatus according to claim 2, characterised in that the pressing mandrel (156) is supported by the winding mandrel (26).

4. Apparatus according to claim 3, characterised in that a shaft section (176) of the winding mandrel (26) rotatably extends through the press die (162).

5. Apparatus according to claim 2, characterised in that the fixing device (64) is an electrical micro-welding device, in that the winding sleeve (14) is made from electrically non-conducting or poorly conducting material or is coated on its inner side with such a material, and that the winding mandrel (26) is connected as a counter-electrode for welding electrodes (70) of the micro-welding device (64).

6. Apparatus according to claim 2, characterised in that the fixing device is a thermal welding device, e.g. it comprises a laser, microgas flames or arc paths.

7. Apparatus according to claim 2, characterised in that the entrainment means (32) are able to be moved between a working position projecting beyond the winding mandrel (26) and a retracted inoperative position.

8. Apparatus according to claim 7, characterised in that the winding mandrel (26) is hollow and extending therein is an adjusting shaft (182), which is connected to the winding mandrel (26) by way of a lost motion connection (186), Operating in the angular direction and which supports the wire members (34) forming the entrainment means, which members are able to be moved by tilting through openings (184) or slots in the winding mandrel (26).

9. Apparatus according to claim 1, characterised in that the winding sleeves (14) are supported by a stepping table (18).

10. Apparatus according to claim 9, characterised in that the supply windows (36) of the winding sleeves (14) are provided in a section of the peripheral wall of the winding sleeves (14) which is substantially parallel to the winding sleeve path (60).

11. Apparatus according to claim 9, characterised in that the fixing device (64) is arranged laterally outside the winding sleeve path (60, 62), preferably opposite the supply window (36).

12. Apparatus according to claim 10, characterised in that the fixing device (64) is a micro-welding device and a counter-electrode (78) able to be wound between the uppermost layers of the knitted roll (76) can be withdrawn (90–96) in the one axial direction and the winding mandrel (26) can be withdrawn in the other axial direction from the winding sleeve (14).

13. Apparatus according to claim 12, characterised by an electrode drive (88) for rotating the counter-electrode (78), in the winding direction (34), which is started by a sensor (86) responsive to presence of the end of the knitted piece, which is located upstream of the first point of contact of the knitted piece with the knitted roll (76) by the length of the knitted layers to be wound over the counter-electrode (78), or is started by a comparator, which receives the output signal of a sensor, which makes available a signal corresponding to the length of the part of the knitted piece (40) wound on the roll.

14. Apparatus according to claim 13, characterised by a second sensor (54) for the end of the knitted piece, which is located in a space-fixed manner in the immediate vicinity of the supply window (36) of the winding sleeve (14) or is carried by the winding sleeve (14) and whereof the output signal is used for controlling the stopping of the electrode drive (88).

15. Apparatus according to claim 14, characterised in that the second sensor (54) responsive to the presence of the end of the knitted piece and a third sensor (120) responsive to the presence of the end of a knitted piece are located directly in front of the supply window (36) of the winding sleeve (14) and an auxiliary counter (118) is activated or deactivated by their output signals, which counter receives the output signal of a digital angle transmitter (114) cooperating with the winding mandrel (26), in that a correction memory (128) is addressed with that output signal of the auxiliary counter (118) that is obtained when the end of the knitted piece has passed the two sensors responsive to the presence of the end of the knitted piece in which correction memory residual angle signals associated with the residue of the knitted piece are stored for the respective angle geometry and thickness of the knitted piece (40) and in that the stopping of the electrode drive (88) is controlled by the residual angle signal respectively read from the correction memory (128).

* * * * *